US009803497B2

(12) United States Patent
Le Biez et al.

(10) Patent No.: US 9,803,497 B2
(45) Date of Patent: Oct. 31, 2017

(54) TURBINE ENGINE STATOR WALL COVERED IN AN ABRADABLE COATING

(71) Applicant: SNECMA, Paris (FR)

(72) Inventors: Philippe Charles Alain Le Biez, Draveil (FR); Nicolas Cornacchia, Draveil (FR); Lionel Marcin, Maisons-Alfort (FR); Pierre Marie Montfort, Paris (FR)

(73) Assignee: SNECMA, Paris (FR)

( * ) Notice: Subject to any disclaimer, the term of this patent is extended or adjusted under 35 U.S.C. 154(b) by 386 days.

(21) Appl. No.: 14/405,545

(22) PCT Filed: May 30, 2013

(86) PCT No.: PCT/FR2013/051212
§ 371 (c)(1),
(2) Date: Dec. 4, 2014

(87) PCT Pub. No.: WO2013/182782
PCT Pub. Date: Dec. 12, 2013

(65) Prior Publication Data

US 2015/0139787 A1 May 21, 2015

(30) Foreign Application Priority Data

Jun. 4, 2012 (FR) ..... 12 55169

(51) Int. Cl.
*F01D 11/12* (2006.01)
*F04D 29/52* (2006.01)
(Continued)

(52) U.S. Cl.
CPC ..... *F01D 11/125* (2013.01); *F01D 25/005* (2013.01); *F04D 29/023* (2013.01);
(Continued)

(58) Field of Classification Search
CPC ..... F01D 11/12; F01D 11/122; F01D 11/125
See application file for complete search history.

(56) References Cited

U.S. PATENT DOCUMENTS 2,628,693 A * 2/1953 Rodger ..... F16D 69/0416 188/234
4,436,848 A * 3/1984 Haines ..... C08J 3/03 428/378

(Continued)

FOREIGN PATENT DOCUMENTS

| | | |
|---|---|---|
| DE | 10 2004 031 255 | 1/2006 |
| EP | 0 192 162 | 8/1986 |
| EP | 2 317 079 | 5/2011 |

OTHER PUBLICATIONS

International Search Report dated Sep. 11, 2013 in PCT/FR13/051212 Filed May 30, 2013.

*Primary Examiner* — Kenneth Bomberg
*Assistant Examiner* — John S Hunter
(74) *Attorney, Agent, or Firm* — Oblon, McClelland, Maier & Neustadt, L.L.P.

(57) ABSTRACT

An annular turbine engine stator portion including a structural support provided in succession with a bonding underlayer and with an abradable coating formed by a resin filled with microbeads, the bonding underlayer for fastening the abradable coating to the structural support being formed by fiber reinforcement made of long fibers having a peripheral portion of the reinforcement that is secured to the structural support and having a central portion thereof that is impregnated with the resin filled with microbeads while the abradable coating is being fastened to the structural support.

10 Claims, 1 Drawing Sheet

(51) Int. Cl.
*F04D 29/02* (2006.01)
*F04D 29/00* (2006.01)
*F01D 25/00* (2006.01)

(52) U.S. Cl.
CPC ..... *F04D 29/526* (2013.01); *F05D 2220/32* (2013.01); *F05D 2240/11* (2013.01); *F05D 2300/44* (2013.01); *F05D 2300/603* (2013.01); *F05D 2300/611* (2013.01); *F05D 2300/614* (2013.01); *F05D 2300/702* (2013.01)

(56) References Cited

U.S. PATENT DOCUMENTS

| | | | | |
|---|---|---|---|---|
| 4,460,185 | A * | 7/1984 | Grandey | F01D 11/122 277/415 |
| 4,639,388 | A | 1/1987 | Ainsworth et al. | |
| 5,388,959 | A * | 2/1995 | Forrester | F01D 11/122 415/173.4 |
| 8,578,697 | B2 * | 11/2013 | Harper | F01D 11/122 181/214 |
| 2009/0214824 | A1 | 8/2009 | Daeubler et al. | |
| 2009/0277153 | A1 * | 11/2009 | Harper | F01D 11/122 60/39.091 |
| 2011/0103940 | A1 | 5/2011 | Duval et al. | |

* cited by examiner

TURBINE ENGINE STATOR WALL COVERED IN AN ABRADABLE COATING

BACKGROUND OF THE INVENTION

The invention relates to turbine engine stator walls provided with abradable coatings, and in particular for use in aeroengines, such as fan retention casings or low-pressure compressor casings.

Such a casing may be made up of a plurality of touching wall sectors that together surround rotary blades driven in rotation by combustion gas. It is also possible for the wall to comprise a closed structure or to be made up of two half-shells. In order to ensure that operation takes place with little clearance, and thus in order to ensure that the turbine engine provides the requested performance in terms of consumption and efficiency, the rotary blades need to come into contact with abradable coatings arranged on the casing. Typically, an abradable coating is constituted by a material based on a resin filled with a pore-generating agent of the type comprising hollow microbeads made of refractory material, and the coating is usually formed by molding or by physical deposition, e.g. by thermal spraying, onto the surface that is to be protected.

Unfortunately, depending on the nature of the structural portion, i.e. depending on whether it is made of metal or of composite material, it can be found that the abradable material can lose adhesion, causing it to become separated and thus to greater or smaller quantities of the material constituting the coating being ingested by the bypass stream of the turbine engine.

In order to solve this problem of loss of adhesion, it is known to sand or grind the structural portion prior to depositing the thermal protection. Unfortunately, that solution cannot be generalized to surfaces that have received electrolytic or electrochemical treatment for protection or passivation purposes, since such an operation has the consequence of destroying that particular treatment.

OBJECT AND SUMMARY OF THE INVENTION

A main object of the present invention is thus to mitigate such drawbacks by proposing a stator wall with an abradable coating that can cover any type of surface, whether made of metal or of composite material, without being subjected to such localized separation of adhesion.

This object is achieved by an annular turbine engine stator portion comprising a structural support provided in succession with a bonding underlayer and with an abradable coating formed by a resin filled with microbeads, the stator portion being characterized in that said bonding underlayer for fastening said abradable coating to said structural support is formed by fiber reinforcement made of long fibers having a peripheral portion of the reinforcement that is secured to said structural support and having a central portion thereof that is impregnated with said resin filled with microbeads while said abradable coating is being fastened on said structural support.

Thus, because it passes through fiber reinforcement made of long fibers, the abradable coating is firmly secured to the structural support, thereby avoiding any localized separation. The invention is thus particularly suitable for stator casing portions made of anodized aluminum, where it is not possible to perform any surface preparation by grinding or sanding.

In an advantageous provision, said fiber reinforcement comprises one or more juxtaposed plies of two-dimensional (2D) long-fiber fabric. Said fiber reinforcement may comprise a non-impregnated 2D fabric ply of glass fibers or of any other long-fiber reinforcement, or indeed a plurality of plies that are pre-impregnated at least in part at their periphery with 2D fabric of glass fibers or of any other long-fiber reinforcement.

According to another advantageous provision, said structural support may be based on a metal alloy, and said peripheral portion is adhesively bonded to said structural support by means of an epoxy resin, or indeed it may be based on composite material, and said peripheral portion is co-cured with said structural support while preparing said structural support.

Preferably, said resin filled with microbeads is a silicone resin or an epoxy resin and said microbeads are hollow beads of glass or of a refractory material.

Advantageously, said abradable coating is fastened to said structural support by deposition by thermal spraying, by injection, by molding, or indeed by spreading, in such a manner as to impregnate said fiber reinforcement and said structural support.

The invention also provides any turbine engine stator including an annular portion as specified above.

BRIEF DESCRIPTION OF THE DRAWING

Other characteristics and advantages of the present invention appear from the following description made with reference to the accompanying drawing which shows an embodiment having no limiting character, and in which.

DETAILED DESCRIPTION OF EMBODIMENTS

Figure 1:
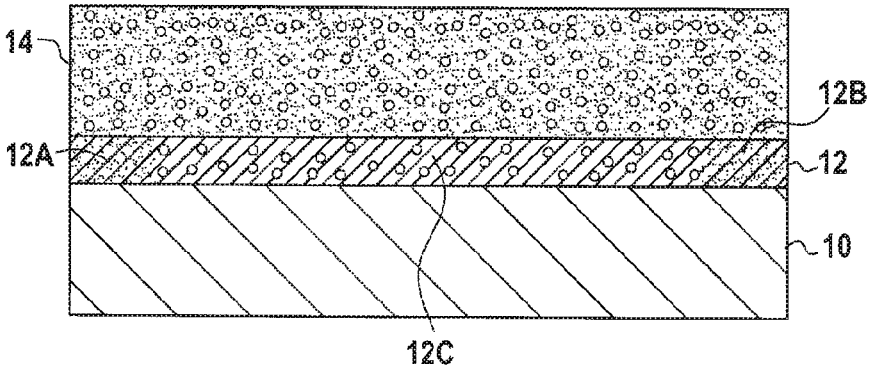
FIG. 1 is a section view of an annular turbine engine stator portion of the invention made of metal.

FIG. 1 is a section view of a portion of a retention casing of an axial turbine engine fan, e.g. formed by connecting a plurality of sectors together end-to-end in the circumferential direction. The casing surrounds a rotary assembly made up of a plurality of blades (not shown), with the clearance between the inside surface of the casing and the tips of the blades being zero or almost zero.

This annular stator portion comprises a structural support 10 provided on the inside (facing the flow of combustion gas) and in succession: a bonding layer 12; and a thermal protection coating 14 made of an abradable material having pores and into which the tips of the blades can penetrate in part without suffering severe wear.

In this first embodiment, the structural support 10 is made of metal alloy, e.g. a titanium or an aluminum alloy.

The thermal protection coating 14 is made of a material having pores, and of satisfactory strength at the temperatures usually encountered in operation. Conventionally, in order to constitute this abradable coating, recourse is had to materials based on silicone or epoxy resin filled with a pore-generating agent of the hollow microbead type made of refractory material, and in particular of glass.

In the invention, the bonding underlayer 12 serving to bond the abradable coating with the surface of the structural support is formed by reinforcement of glass fibers or any other long-fiber reinforcement (e.g. using carbon or aramid fibers) that is secured in part at its periphery to the structural support 10.

The fiber reinforcement is constituted by one or more juxtaposed plies of two-dimensional long-fiber fabric. When the reinforcement has only one ply, it is preferably not impregnated (dry) and it is advantageously adhesively bonded to the structural support 10 at its periphery (or at least along two of its lateral edges 12A and 12B) using an epoxy resin (or indeed a silicone resin when the abradable coating is based on silicone). In contrast, when the composite reinforcement comprises a plurality of plies, they are independent of one another and they may then be previously pre-impregnated at least in part at their periphery, in particular along their lateral edges, and they are then held by being adhesively bonded along these lateral edges to the structural support 10, e.g. using epoxy resin. This impregnation may advantageously be performed manually (laminating by hand), e.g. using a roller or a spray gun.

In these two configurations, the central portion of the reinforcement 12C is left free (i.e. not adhesively bonded to the structural support) and it is impregnated during the physical deposition of the abradable coating, e.g. by thermally spraying powder, while using known plasma deposition techniques when the fabric is made of metal long fibers. In other circumstances, the abradable material may merely be injected, molded, or spread in such a manner as to impregnate the fiber reinforcement and the surface of the structural support.

Figure 2:
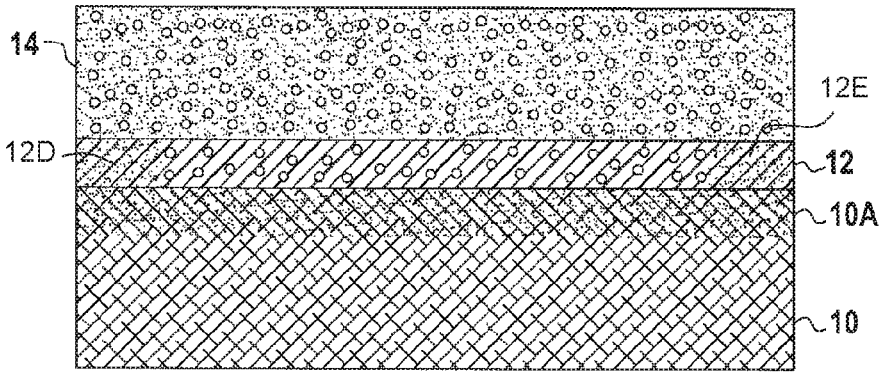
FIG. 2 is a section view of an annular turbine engine stator portion made of composite material.

FIG. 2 shows another embodiment of the invention that is more particularly adapted to a structural support 10 that is made of composite material being constituted in conventional manner by fiber reinforcement made of carbon, glass, aramid, or ceramic fibers embedded in an epoxy resin or in a resin having similar properties. Under such circumstances, the bonding underlayer 12 is not bonded at its periphery directly on the structural support 10 with the help of an epoxy resin, but each lateral edge 12D, 12E is preferably co-cured together with the structural support while the structural support is being prepared in such a manner that the reinforcement is directly incorporated with the structural support's own reinforcement of fibers 10A structuring its surface. Naturally, care is taken to ensure that this curing does not affect the central portion that is to remain free. The structure of the bonding underlayer 12 is nevertheless identical to the structure described above and is formed by reinforcement of glass fibers or of any other long reinforcing fibers comprising a dry ply or a plurality of pre-impregnated plies of two-dimensional long-fiber fabric that are nevertheless co-cured with and not adhesively bonded to the structural support.

The invention claimed is:

1. An annular turbine engine stator portion comprising: a structural support provided in succession with a bonding underlayer and with an abradable coating formed by a resin filled with microbeads, the bonding underlayer having a peripheral portion and a central portion and fastening the abradable coating to the structural support, the bonding underlayer formed of fiber reinforcement made of fibers, only the peripheral portion of the bonding underlayer secured to the structural support by adhesive bonding or by co-curing, the central portion of the bonding underlayer impregnated during deposition of said abradable coating.

2. An annular turbine engine stator portion according to claim 1, wherein the fiber reinforcement comprises one or more juxtaposed plies of fiber fabric.

3. An annular turbine engine stator portion according to claim 2, wherein the fiber reinforcement comprises a non-impregnated fabric ply of glass fibers or of any other fiber reinforcement.

4. An annular turbine engine stator portion according to claim 2, wherein the fiber reinforcement comprises a plurality of plies that are pre-impregnated at least in part at their periphery with fabric of glass fibers or of any other fiber reinforcement.

5. An annular turbine engine stator portion according to claim 1, wherein the structural support is based on a metal alloy, and the peripheral portion is adhesively bonded to the structural support by an epoxy resin.

6. An annular turbine engine stator portion according to claim 1, wherein the structural support is based on composite material, and the peripheral portion is co-cured with the structural support while preparing the structural support.

7. An annular turbine engine stator portion according to claim 1, wherein the resin filled with microbeads is a silicone resin or an epoxy resin.

8. An annular turbine engine stator portion according to claim 7, wherein the microbeads are hollow beads of glass or of a refractory material.

9. An annular turbine engine stator portion according to claim 1, wherein the abradable coating is fastened to the structural support by deposition by thermal spraying, by injection, by molding, or by spreading, to impregnate the fiber reinforcement and the structural support.

10. A turbine engine stator comprising a plurality of annular portions according to claim 1.

* * * * *